US006656274B2

(12) United States Patent
Claassen et al.

(10) Patent No.: US 6,656,274 B2
(45) Date of Patent: Dec. 2, 2003

(54) DEVICE FOR THE DOSING AND DISTRIBUTION OF HOTMELT

(75) Inventors: Wilhelmus J. A. L. M. Claassen, Boxmeer (NL); Martinus H. B. M. Rutten, Boxmeer (NL)

(73) Assignee: Stork Brabant B.V., Boxmeer (NL)

( * ) Notice: Subject to any disclaimer, the term of this patent is extended or adjusted under 35 U.S.C. 154(b) by 0 days.

(21) Appl. No.: 10/021,418

(22) Filed: Oct. 29, 2001

(65) Prior Publication Data

US 2002/0076496 A1 Jun. 20, 2002

Related U.S. Application Data

(63) Continuation of application No. PCT/NL00/00292, filed on May 8, 2000.

(30) Foreign Application Priority Data

May 7, 1999 (NL) ..... 1011993

(51) Int. Cl.[7] ..... B05C 17/06

(52) U.S. Cl. ..... 118/213; 118/301; 118/406; 427/272; 427/282; 427/96; 101/123; 101/126

(58) Field of Search ..... 118/213, 301, 118/406; 101/123, 126, 127, 127.1; 427/272, 282, 96

(56) References Cited

U.S. PATENT DOCUMENTS

| | | | | |
|---|---|---|---|---|
| 3,986,450 A | | 10/1976 | Zimmer | |
| 4,622,239 A | * | 11/1986 | Schoenthaler et al. | 427/96 |
| 5,099,758 A | | 3/1992 | Hassler et al. | |
| 5,483,884 A | * | 1/1996 | Vellanki | 101/129 |
| 5,584,932 A | * | 12/1996 | Clark et al. | 118/669 |
| 6,145,434 A | * | 11/2000 | Tanaka et al. | 101/129 |
| 6,458,211 B1 | * | 10/2002 | Wefers et al. | 118/669 |

FOREIGN PATENT DOCUMENTS

| | | |
|---|---|---|
| DE | 197 36 563 C1 | 10/1988 |
| EP | 0 049 362 | 4/1982 |
| EP | 0 390 771 | 10/1990 |
| EP | 0 865 920 A2 | 9/1998 |
| NL | 1005308 | 8/1998 |

* cited by examiner

*Primary Examiner*—Laura Edwards
(74) *Attorney, Agent, or Firm*—Hoffman & Baron, LLP

(57) ABSTRACT

A device for dosing and distribution of hotmelt on a substrate is provided. The device includes substrate throughput, hotmelt supply, at least one hotmelt application position with a stencil, hotmelt distribution and a squeegee device. The hotmelt distribution includes a hotmelt dispensing nozzle. A dosing unit and drive for moving the dosing unit to and fro along said squeegee device are also provided. The hotmelt dispensing nozzle is fitted on the movable dosing unit.

15 Claims, 4 Drawing Sheets

2
3
4
10
11
15
16
17
20
21

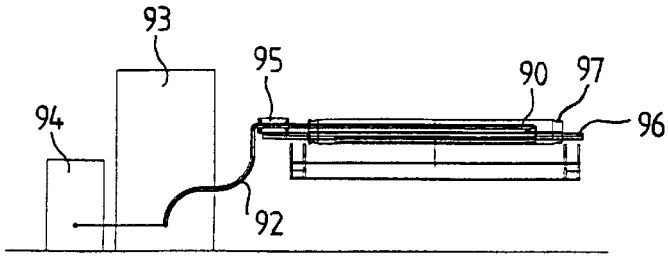
Fig 9a
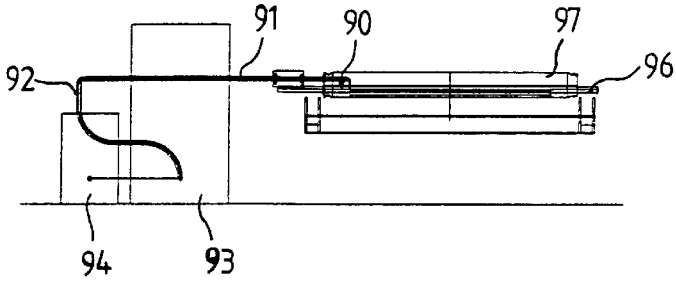
Fig 9b
Fig 10a
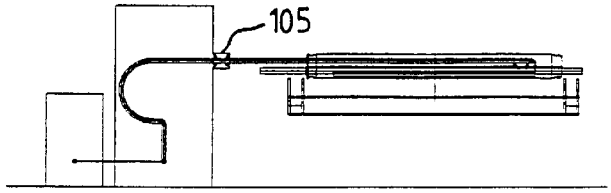
Fig 10b
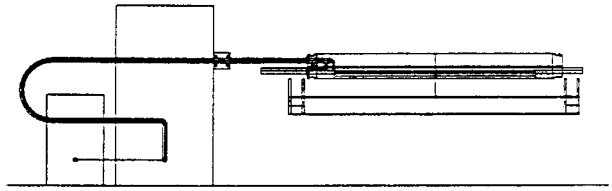
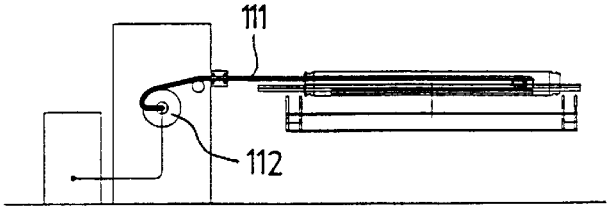
Fig 11a
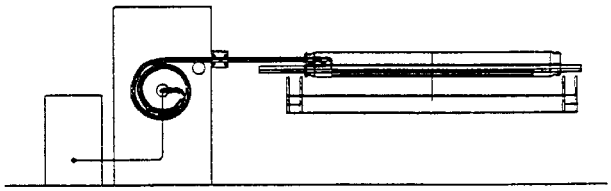
Fig 11b

DEVICE FOR THE DOSING AND DISTRIBUTION OF HOTMELT

CROSS-REFERENCE TO RELATED APPLICATION

This is a continuation application of PCT/NL00/00292 filed May 8, 2000, which PCT application claims priority on NL application number 1011993 filed May 7, 1999, herein incorporated by reference.

FIELD OF THE INVENTION

The invention relates to a device for the dosing and distribution of a hotmelt on a substrate.

BACKGROUND OF THE INVENTION

A device is known which comprises a hotmelt distribution pipe extending over the entire length of a stencil along a squeegee element. The distribution pipe is provided with a large number of outflow apertures situated next to each other in the longitudinal direction. During operation, the hotmelt is supplied to one side of the distribution pipe. The outflow apertures situated next to each other have cross sections that increase by a certain step size, viewed in a direction downstream of the hotmelt supply side. This is an attempt to compensate for the fall in pressure of the hotmelt in the distribution pipe and to obtain a substantially uniform distribution of hotmelt.

A disadvantage in the case of this known device is that, depending on the type of hotmelt and the hotmelt temperature to be applied, an appropriate distribution pipe with a specific distribution and step size in outflow apertures must be used. The hotmelt temperature in particular can vary greatly, and consequently so can the viscosity of the hotmelt. Furthermore, depending on the application width on the substrate, an appropriate length of distribution pipe must be selected. This means that a user soon needs several different distribution pipes. It has been found in practice that the distribution of the hotmelt leaves much to be desired. On completion of a distribution cycle and/or on changing over to another type of hotmelt and/or on changing over to another distribution pipe, the entire hotmelt contents of the distribution pipe are lost. In particular, when a reactive hotmelt is being used, for example a hotmelt that hardens irreversibly on contact with air, special measures have to be taken to prevent undesirable permanent hardening of the hotmelt. For instance, during a fairly long stop or during storage of the distribution pipe, the distribution pipe must be placed in a solvent, or the distribution pipe must be filled with a purge, for example a thermoplastic hotmelt that stops the reaction process of the reactive hotmelt. This again leads to large quantities of hotmelt being lost.

Furthermore a device is known from DE-C-197 36 563. This device comprises a stencil inside which a squeegee, a hollow profile element for the distribution of hotmelt and a profile element with a heating element for the heating of the hotmelt are positioned. The profile elements are positioned on opposite sides of the squeegee and extend over substantially the entire length of the squeegee, thus clamping the squeegee in between. The hollow profile element is rectangular in cross-section and is provided in its bottom wall with a large number of outflow apertures situated next to each other in the longitudinal direction.

A disadvantage of this known device is that depending on the desired application width, the type of hotmelt and hotmelt temperature to be applied, an appropriate assembly of squeegee and profile elements must be used. In practice it is suggested for this type of device to close the outflow apertures all together airtight by means of an adhesive metal tape, should a long stop or storage of the assembly be envisaged. Thus it is hoped to prevent undesirable hardening of the hotmelt inside the hollow profile element. This taping process is time consuming since it is necessary to remove the entire assembly out of the stencil before being able to adhere the tape. During the removal of the assembly, there is the risk of hotmelt dripping out of the outflow apertures at undesirable places. A compensation for the fall in pressure of the hotmelt in the hollow profile element during use, is not provided for, leading to a not uniform distribution of hotmelt.

SUMMARY OF THE INVENTION

The object of the present invention is to provide a device in which the above mentioned disadvantages are overcome, and in particular to provide a device by means of which at different application widths and/or with different types of hotmelt optimum hotmelt distribution can be obtained in a flexible manner with one and the same distribution system.

This object is achieved according to the invention by a device for dosing and distribution of hotmelt on a substrate, comprising substrate throughput means, hotmelt supply means, and at least one hotmelt application position with a stencil, hotmelt distribution means and a squeegee device, said hotmelt distribution means comprising a hotmelt dispensing nozzle, wherein a dosing unit and drive means for moving said dosing unit to and fro along said squeegee device are provided, said hotmelt dispensing nozzle being fitted on said movable dosing unit. The device has at least one hotmelt application position for applying hotmelt to a substrate. This device can be designed both for the application of a hotmelt print and for the application of a hotmelt coating. The application position comprises a stencil and a squeegee device, and a dosing unit that is movable along the squeegee device. The dosing unit comprises a nozzle for dispensing hotmelt. The nozzle is in flow or fluid communication with hotmelt supply means. The hotmelt supply means are designed to follow the movement of the dosing unit and comprise heating means for keeping the hotmelt at the correct temperature. The dosing unit can be moved to and fro along the squeegee device by means of conveyor means and at the same time, by means of a suitable control of the supply means, can dispense a desired quantity of hotmelt at the position of a squeegee element of the squeegee device. The squeegee element presses the hotmelt through the stencil onto the substrate. Thanks to the movable dosing unit, the hotmelt can be distributed very accurately over the length of the squeegee device. The quantity of hotmelt dispensed and the application width over which the dosing unit is moved to and fro can be adjusted accurately in a simple manner. This makes the device flexible and cheap to use, and in particular readily adaptable to various types of hotmelt, different hotmelt temperatures and different application widths. Moreover, the dosing and distribution is reliable, partly due to the fact that the nozzle can be designed with a relatively large cross section, which minimizes the risk of blockage. At the end of a distribution cycle and/or on changing over to another printing width, little or no hotmelt need be lost. It is advantageous that no expensive and time-consuming measures need be taken when a reactive hotmelt is being used.

In particular, the device further comprises purge supply means, and the dosing unit is further provided with a purge dispensing nozzle that is in flow or fluid communication with the purge supply means. This means that after the completion of a distribution cycle a quantity of purge can be distributed over the length of the squeegee device using one and the same movable dosing unit. This is important particularly if a reactive hotmelt has been used. The purge flushes the reactive hotmelt out of the stencil and the squeegee device and further prevents the reactive hotmelt from undesirably continuing its reaction.

More particularly, the above mentioned purge dispensing nozzle is disposed in such a way that said nozzle opens out in the hotmelt dispensing nozzle, near the free end thereof The supply of a small quantity of purge then suffices to expel the hotmelt from the front part of the hotmelt dispensing nozzle and to cause a sealing plug of purge medium to form there. The sealing plug prevents the hotmelt from continuing its reaction, so that it cannot, for example, further irreversibly harden to the air. In this variant of an embodiment the purge can be formed, for example, by a thermoplastic hotmelt. The formation of a sealing plug of purge medium advantageously also occurs automatically if fairly large quantities of purge are metered along the squeegee device.

The invention also relates to a movable dosing unit for the above stated device, an assembly of such a dosing unit with a squeegee device for the above stated device, and a method for applying a hotmelt to a substrate with the above stated device.

BRIEF DESCRIPTION OF THE DRAWINGS

The invention will be explained in greater detail with reference to the appended drawing, in which:

FIGS. 9*a* and 9*b* respectively are diagrammatic views of an application position with a dosing unit in a first and second position respectively;

FIGS. 10*a* and 10*b* are diagrammatic views according to FIGS. 9*a* and 9*b* of a variant;

FIGS. 11*a* and 11*b* are diagrammatic views according to FIGS. 9*a* and 9*b* of a further variant.

DESCRIPTION OF THE PREFERRED EMBODIMENTS

Figure 1:
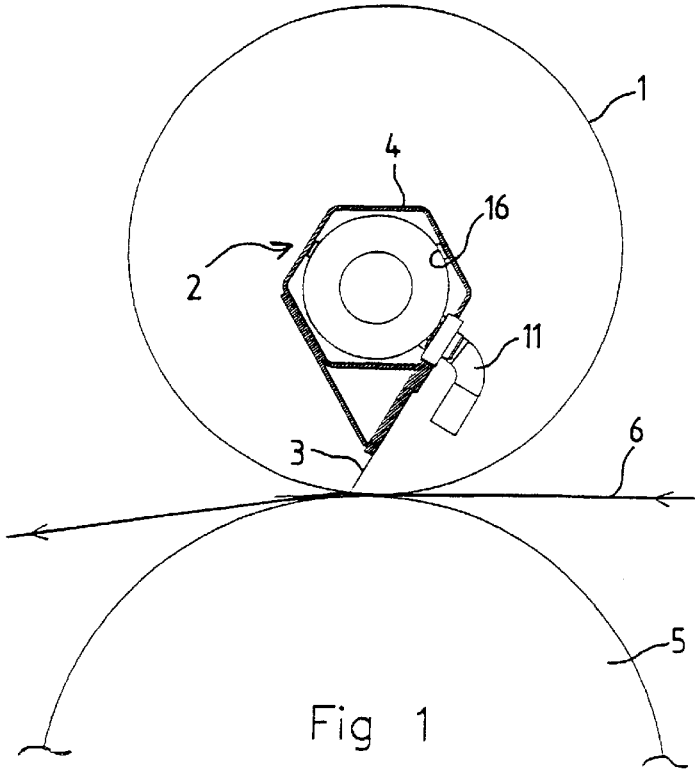
FIG. 1 is a diagrammatic view in cross section of an application position of a preferred embodiment of the device according to the invention.
Figure 5:
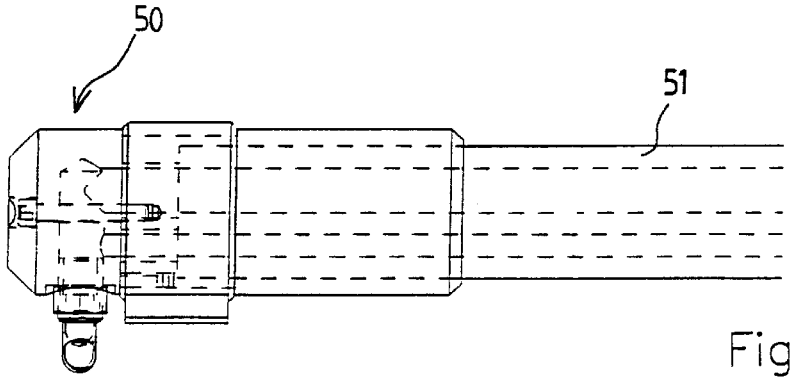
FIG. 5 is a view from above of a variant of a movable dosing unit.
Figure 6:
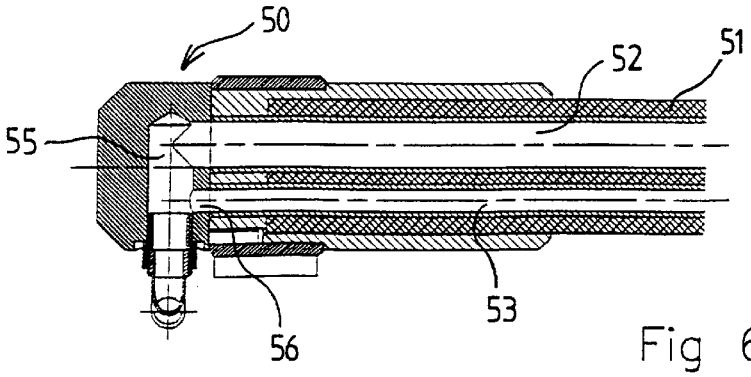
FIG. 6 is a view in longitudinal section of FIG. 5.

The application position in FIG. 1 comprises a drivable stencil 1 with a squeegee device 2 fitted therein. The squeegee device 2 comprises a squeegee element 3 and a bearing section piece 4. The stencil 1 is fitted above a separately drivable counterpressure roller 5 (of which only the top part is shown). A substrate 6 can be conveyed between the stencil 1 and the counterpressure roller 5. The bearing section piece 4 of the squeegee device 2 is of a hollow design. A dosing unit 10 which is movable to and fro is provided inside the hollow bearing section piece 4. The dosing unit 10 is provided with a nozzle 11 for dispensing hotmelt. The device is intended for the application of hotmelt to the substrate 6. During an application cycle the substrate 6 is conveyed along the stencil 1, the stencil 1 and the counterpressure roller 5 being driven separately. At the same time, the dosing unit 10 is moved to and fro through the bearing section piece 4. The direction of movement of the dosing unit 10 in this case is perpendicular to the direction of conveyance of the substrate 6. By way of the nozzle 11, hotmelt is distributed over the application width repeatedly during the to and fro movements of the dosing unit 10, and is dispensed near the squeegee element 3. The squeegee element 3 presses the hotmelt through the stencil 1. By synchronizing the speed of movement of the dosing unit 10 with the throughput speed of the substrate 6, it can advantageously be ensured that sufficient hotmelt is present over the entire length of the squeegee element 3 during the entire application cycle.

Figures 2, 3, 4:
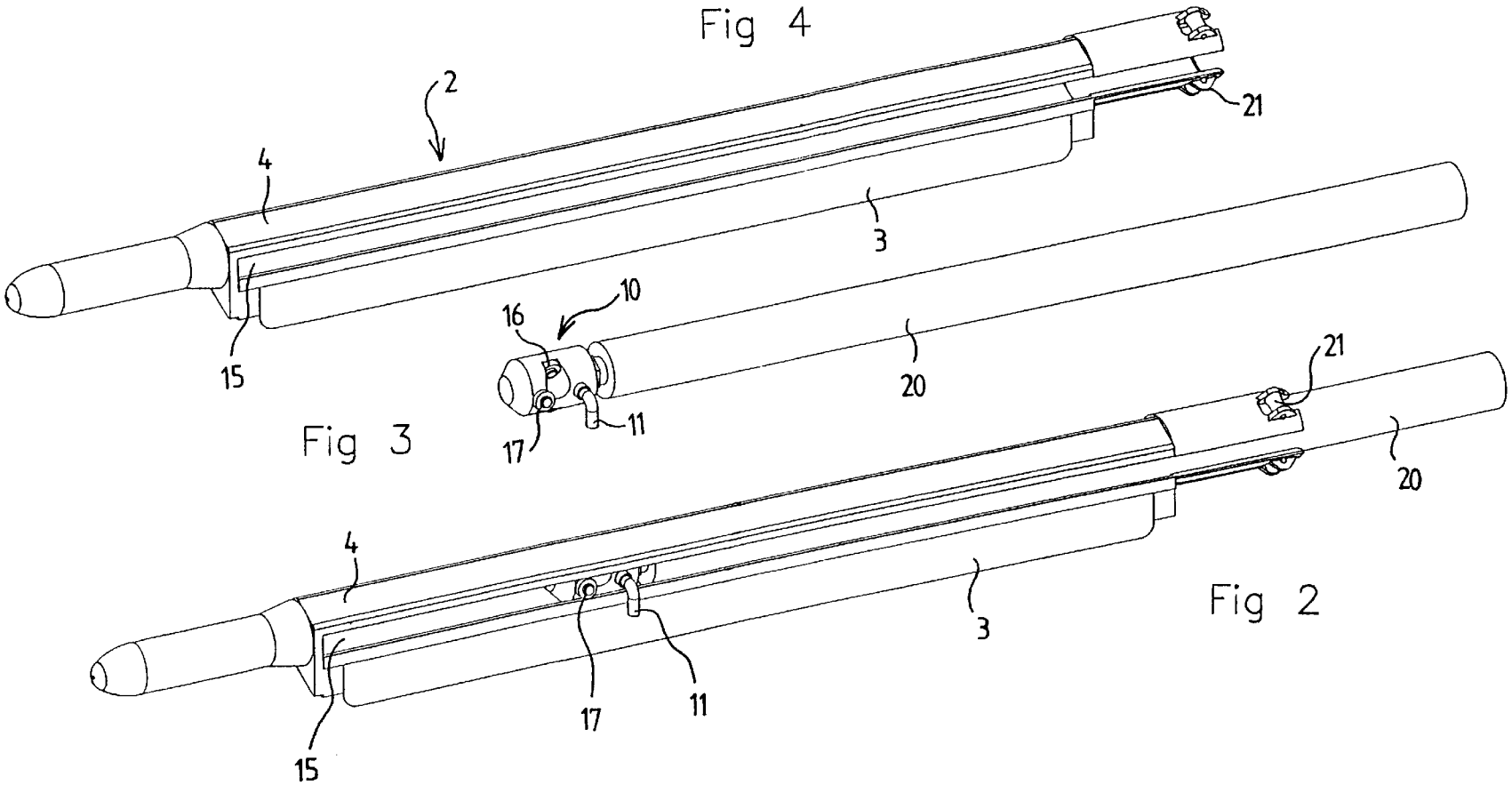
FIG. 2 is a view in perspective of the assembly of squeegee device with dosing unit in FIG. 1.
FIG. 3 is a view in perspective of the dosing unit with supply means in FIG. 2.
FIG. 4 is a view in perspective of the squeegee device in FIG. 2.
Figure 7:
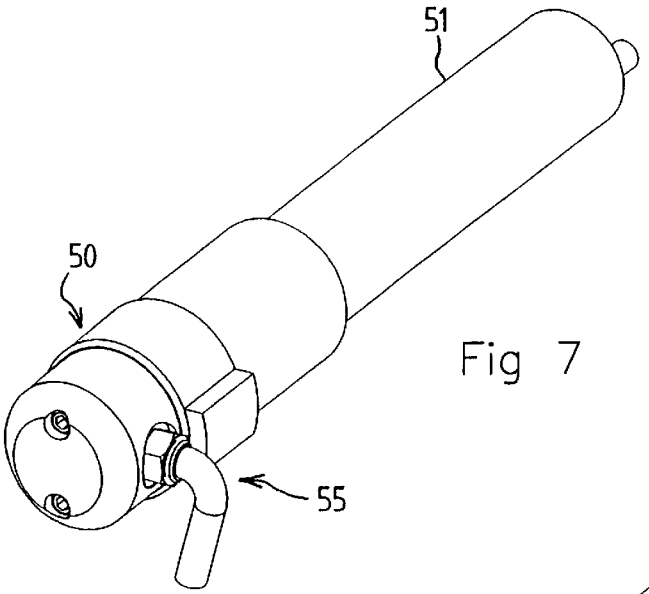
FIG. 7 is a view in perspective of FIG. 5.
Figure 8:
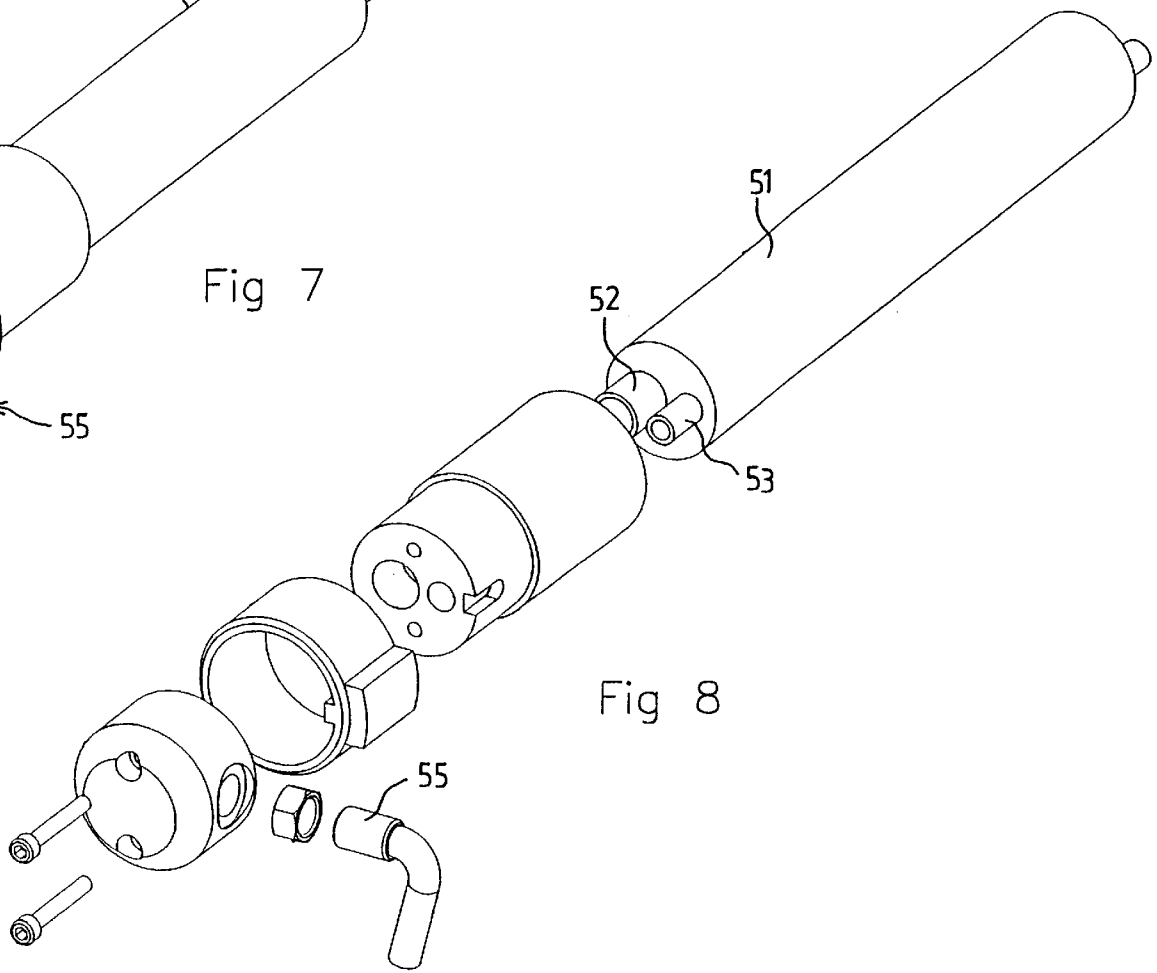
FIG. 8 is a view of FIG. 5 with disassembled parts.

It can be seen clearly in FIGS. 2–4 that the hollow bearing section piece 4 is provided with a longitudinal slit 15, through which the nozzle 11 projects outwards and can move to and fro.

The dosing unit 10 is provided with three friction-reducing guide elements 16, which are fitted around the external periphery and are formed by, for example, small wheels. In addition, a guide wheel 17, which rests against one of the longitudinal edges of the slit 15, is provided. This means that the dosing unit 10 can be moved to and fro with little force.

The dosing unit 10 is connected to a supply hose 20 (see FIGS. 2 and 3). The supply hose 20 is supported by guide wheels 21 at one end face of the squeegee device 2. During the movement to and fro of the dosing unit 10 along the squeegee device 2, the hose 20 will move to and fro along with it.

The supply hose 20 can be provided with a single throughput line that is in flow communication with the nozzle 11. During an application cycle hotmelt is then supplied through the supply hose 20, while after an application cycle has finished purge can be supplied through the same throughput line in the supply hose 20 to the nozzle 11. The entire throughput line and nozzle are flushed clean with purge in this way. Moreover, so much purge can be supplied that the stencil 1 and the squeegee device 2 are also to some extent flushed clear of hotmelt.

FIGS. 5–8 show a preferred embodiment of the dosing unit 50, in which the supply hose 51 connected to the dosing unit 50 houses both a hotmelt supply line 52 and a separate purge supply line 53. The hotmelt supply line 52 is enclosed by a heating element, which serves to prevent the hotmelt from cooling down. The hotmelt supply line 52 is in flow or fluid communication with a hotmelt dispensing nozzle 55 on the dosing unit 50. The purge supply line 53 is in flow or fluid communication with a purge dispensing nozzle 56. The purge supply line 53 can likewise be enclosed by a heating element, which can serve to ensure that the purge remains at temperature. This is advantageous in particular if a thermoplastic hotmelt is being used as purge. The purge dispensing nozzle 56 is advantageously disposed in such a way that it opens out in the hotmelt dispensing nozzle 55, near the free end thereof. If now the hotmelt supply is stopped when an application cycle has finished, and the purge supply is switched on, the result of this is that the hotmelt present in the last part of the hotmelt dispensing nozzle 55 is forced out by the purge fed in. With this the purge at the same time automatically shuts off from the environment the hotmelt still present in the hotmelt supply line 52. This is advantageous in particular if a reactive hotmelt is being used. Using a thermoplastic hotmelt as purge is then a simple way of preventing the reactive hotmelt inside the dosing unit 50 or inside the hotmelt supply line 52 from permanently hardening to the ambient air. The thermoplastic hotmelt in the last part of the hotmelt dispensing nozzle 55 forms a good seal, will not permanently harden, and can simply be forced out of the last part of the nozzle 55 at the beginning of the next application cycle by the hotmelt again being supplied through the supply line 52 to the nozzle 55.

In a variant the hotmelt supply line and the purge supply line are accommodated in separate supply hoses, each connecting to the dosing unit.

In another variant the dosing unit is provided with a separate purge dispensing nozzle which is in flow communication with a separate purge supply line.

In addition to the embodiment shown in FIGS. 1–4, in which the dosing unit is guided inside a hollow part of the squeegee device, in a variant the dosing unit can also be guided over a guide section provided on the outside of a squeegee device. It is also possible to provide a separate guide section which extends over at least the application width of the application position along a squeegee device. The squeegee element used advantageously is a squeegee blade, because the latter can cut through the hotmelt threads formed in each case during printing.

The dosing unit that is movable to and fro can be conveyed to and fro along the squeegee device in several ways. FIGS. 9*a*–11*b* show three variants thereof In FIGS. 9*a* and 9*b* a dosing unit 90 is connected to a rigid supply pipe 91. The latter in turn is connected to a flexible supply hose 92. The supply hose 92 can be placed as desired either in flow communication with a hotmelt supply 93 or with a purge supply 94. Drive means 95 are provided for the to and fro movement of the dosing unit 90, which drive means act upon the outer peripheral wall of the supply pipe 91. The drive means 95 are mounted on one of the end faces of a squeegee device 96, which extends through a stencil 97. By driving the drive means 95 in a suitable manner, said drive means will force the supply pipe forwards or backwards. The dosing unit 90 moves to and fro along the squeegee device along with the supply pipe 91.

The variant shown in FIGS. 10*a* and 10*b* largely corresponds to that of FIGS. 9*a* and 9*b,* the difference being that drive means 105 in this case are mounted on a fixing point situated outside the squeegee device and the stencil. This means that the squeegee device can be removed when the device is at a standstill, without having to remove the dosing unit, the supply pipe and the drive means at the same time.

FIGS. 11*a* and 11*b* show a variant with a fully flexible supply hose 111, which can be wound onto a reel 112 and unreeled from it again. The hose is flexible, but sufficiently rigid to be able to push the dosing unit in front of it during the unreeling.

Many variants are possible in addition to the embodiments shown, in which the drive means interact with the supply means. For instance, the dosing unit can also be connected to separate movement means, for example a separate pulling and/or pushing element.

Thus a multi-purpose device for dosing and distributing hotmelt on a substrate can be obtained according to the invention. The dosing unit that is movable to and fro is easily adjustable to several application widths and different types of hotmelt to be metered and distributed. A purge dispensing nozzle, which opens out in the last part of the hotmelt dispensing nozzle, can very advantageously also be provided on the dosing unit. This minimizes the loss of hotmelt outside the application cycles, and prevents the hotmelt properties from changing in a negative sense during a fairly long standstill period.

What is claimed is:

1. Device for dosing and distribution of hotmelt on a substrate, comprising:

substrate throughput means;

hotmelt supply means; and at least one hotmelt application position with a stencil, hotmelt distribution means and a squeegee device having a longitudinal direction, said hotmelt distribution means comprising a hotmelt dispensing nozzle; wherein a dosing unit and drive means for moving said dosing unit to and fro along said longitudinal direction of said squeegee device are provided;

said hotmelt dispensing nozzle being fitted on said movable dosing unit.

2. Device according to claim 1, in which purge supply means and purge distribution means are further provided, the purge distribution means comprising a purge dispensing nozzle fitted on said movable dosing unit.

3. Device according to claim 2, in which said purge dispensing nozzle opens out in said hotmelt dispensing nozzle, near a free end thereof.

4. Device according to claim 1, in which said hotmelt supply means comprise a hotmelt supply line which connects to said dosing unit and is in fluid communication with said hotmelt dispensing nozzle.

5. Device according to claim 2, in which said purge supply means comprise a purge supply line which connects to said dosing unit and is in fluid communication with said purge dispensing nozzle.

6. Device according to claim 2, in which said hotmelt supply means comprise a hotmelt supply line which connects to said dosing unit and is in flow communication with said hotmelt dispensing nozzle, in which said purge supply means comprise a purge supply line which connects to said dosing unit and is in flow communication with said purge dispensing nozzle, and in which said hotmelt supply line and said purge supply line are packed together in one enclosing body.

7. Device according to claim 2, in which said hotmelt supply means comprise a hotmelt supply line which connects to said dosing unit and is in flow communication with said hotmelt dispensing nozzle, in which said purge supply means comprise a purge supply line which connects to said dosing unit and is in flow communication with said purge dispensing nozzle, in which said drive means interact with said hotmelt supply line or said purge supply line.

8. Device according to claim 1, further comprising guide means extending along said longitudinal direction of said squeegee device for guiding said dosing unit.

9. Device according to claim 8, in which said guide means form part of said squeegee device.

10. Device according to claim 9, in which said squeegee device comprises a hollow bearing section piece, inside which said movable dosing unit is accommodated and movable to and fro.

11. Device according to claim 10, in which said movable dosing unit is provided with friction-reducing guide elements, which are distributed around an external periphery thereof, for supporting said dosing unit against an internal peripheral wall of said hollow bearing section piece.

12. Device according to claim 10, in which said hollow bearing section piece is provided with a longitudinal slit through which at least a portion of said hotmelt dispensing nozzle extends to the outside.

13. Movable dosing unit for a device for dosing and distribution of hotmelt on a substrate comprising:

substrate throughput means:

hotmelt supply means:

at least one hotmelt application position with a stencil hotmelt distribution means and a squeegee device having a longitudinal direction, said hotmelt distribution means comprising a hotmelt dispensing nozzle: and said movable dosing unit comprising a hotmelt dispensing nozzle which is fitted on said movable dosing unit, said nozzle being in flow communication with hotmelt supply means comprising heating means.

14. Assembly of a movable dosing unit with a squeegee device for a device for dosing and distribution of hotmelt on a substrate, comprising:

substrate throughput means;

hotmelt supply means;

at least one hotmelt application position with a stencil, hotmelt distribution means and said squeegee device having a longitudinal direction, said hotmelt distribution means comprising a hotmelt dispensing nozzle; and said movable dosing unit and drive means for moving said dosing unit to and fro along said longitudinal direction of said squeegee device;

said movable dosing unit comprising a hotmelt dispensing nozzle which is fitted on said movable dosing unit, said nozzle being in flow communication with hotmelt supply means comprising heating means.

15. Method for applying a hotmelt to a substrate, comprising the steps of:

providing a device for dosing and distribution of hotmelt on a substrate, comprising:

substrate throughput means;

hotmelt supply means;

at least one hotmelt application position with a stencil, hotmelt distribution means and a squeegee device having a longitudinal direction, said hotmelt distribution means comprising a hotmelt dispensing nozzle;

a dosing unit and drive means for moving said dosing unit to and fro along said longitudinal direction of said squeegee device, said hotmelt dispensing nozzle being fitted on said movable dosing unit; and purge supply means and purge distribution means, said purge distribution means comprising a purge dispensing nozzle fitted on said movable dosing unit, said method further comprising the steps:

dosing and distributing hotmelt on said stencil by means of a suitable control of said drive means of said dosing unit and of said hotmelt supply means;

pressing out hotmelt present on said stencil as much as possible; and dosing and distributing purge by means of a suitable control of said drive means of said dosing unit and of said purge supply means.

* * * * *